US009441844B2

(12) United States Patent
Eguchi et al.

(10) Patent No.: US 9,441,844 B2
(45) Date of Patent: Sep. 13, 2016

(54) HUMIDITY CONTROLLER

(71) Applicant: DAIKIN INDUSTRIES, LTD., Osaka-shi, Osaka (JP)

(72) Inventors: Akihiro Eguchi, Osaka (JP); Gakuto Sakai, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 180 days.

(21) Appl. No.: 14/384,817

(22) PCT Filed: Mar. 4, 2013

(86) PCT No.: PCT/JP2013/001321

§ 371 (c)(1),
(2) Date: Sep. 12, 2014

(87) PCT Pub. No.: WO2013/136714

PCT Pub. Date: Sep. 19, 2013

(65) Prior Publication Data

US 2015/0027680 A1 Jan. 29, 2015

(30) Foreign Application Priority Data

Mar. 14, 2012 (JP) ..... 2012-057780

(51) Int. Cl.
*F24F 3/14* (2006.01)
*F24F 11/00* (2006.01)
*F25B 13/00* (2006.01)

(52) U.S. Cl.
CPC ..... *F24F 3/1429* (2013.01); *F24F 11/0008* (2013.01); *F25B 13/00* (2013.01)

(58) Field of Classification Search
CPC .. F24F 3/1429; F24F 13/1429; F24F 11/008; F24F 11/02; F24F 3/14; F25B 13/00; F25B 15/00; F25B 17/00
USPC ..... 62/271; 165/222
See application file for complete search history.

(56) References Cited

U.S. PATENT DOCUMENTS 7,937,960 B2 * 5/2011 Matsui ..... F24F 3/1411 236/44 A
2007/0051123 A1 * 3/2007 Matsui ..... B01D 53/261 62/324.5
2007/0180851 A1 8/2007 Fujiyoshi et al.
2008/0092565 A1 * 4/2008 Yabu ..... F24F 3/06 62/94
2008/0265045 A1 * 10/2008 Yabu ..... F24F 3/065 236/44 C
2009/0165484 A1 * 7/2009 Matsui ..... F24F 3/1411 62/271
2009/0229294 A1 * 9/2009 Matsui ..... F24F 3/1411 62/271
2009/0230202 A1 * 9/2009 Matsui ..... F24F 3/1411 236/44 A (Continued)

FOREIGN PATENT DOCUMENTS

JP 3-260561 A 11/1991
JP 2005-283041 A 10/2005

(Continued)

*Primary Examiner* — Mohammad M Ali
(74) *Attorney, Agent, or Firm* — Birch, Stewart, Kolasch & Birch, LLP

(57) ABSTRACT

An on-off valve and a bypass pipe which bypasses the on-off valve are connected to an inlet pipe and an outlet pipe of a humidity control circuit. A pressure-reducing valve is connected to the bypass pipe. Before switching a four-way valve, a degree of opening of the pressure-reducing valve is reduced to reduce a pressure difference between high and low pressure in the humidity control circuit. After that, the on-off valve is closed for pressure equalization between the high and low pressure in the humidity control circuit.

1 Claim, 7 Drawing Sheets

(56) References Cited

U.S. PATENT DOCUMENTS

2010/0257885 A1* 10/2010 Matsui ..... F24F 3/1411
62/271

FOREIGN PATENT DOCUMENTS

JP 2005283 * 10/2005 ..... F24F 11/02
JP 2005-315559 A 11/2005

* cited by examiner

HUMIDITY CONTROLLER

TECHNICAL FIELD

The present invention relates to humidity controllers.

BACKGROUND ART

Air conditioning systems which control humidity of outdoor air and room air and supply the humidity-controlled air into a room have been known (see, e.g., Patent Document 1). These air conditioning systems include a refrigerant circuit which performs a refrigeration cycle by circulating a refrigerant. The refrigerant circuit is comprised of a heat-source-side circuit to which a compressor that compresses the refrigerant is connected, and a plurality of humidity control circuits connected in parallel to the heat-source-side circuit by a connecting pipe. First and second adsorption heat exchangers, an expansion valve, and a four-way valve are connected to the humidity control circuit. The adsorption heat exchanger is comprised of a heat exchanger carrying an adsorbent on its surface.

A first port of the four-way valve is connected to a discharge side of the compressor of the heat-source-side circuit by a discharge-gas connecting pipe. A second port is connected to a suction side of the compressor of the heat-source-side circuit by a suction-gas connecting pipe. A third port is connected to a gas side end of the first adsorption heat exchanger. A fourth port is connected to a gas side end of the second adsorption heat exchanger.

When the four-way valve is in a first state, in which the first port and the third port are connected to each other and the second port and the fourth port are connected to each other, the high pressure side of the heat-source-side circuit and the first adsorption heat exchanger are connected to each other, and the low pressure side of the heat-source-side circuit and the second adsorption heat exchanger are connected to each other. In this state, the high-pressure refrigerant compressed by the compressor is separated into the humidity control circuits and is condensed by the first adsorption heat exchanger. The condensed refrigerant is decompressed by the expansion valve, and thereafter evaporates in the second adsorption heat exchanger. The evaporated refrigerant is gathered in the heat-source-side circuit and is sucked again in the compressor. Thus, in the respective humidity control circuits, the adsorbent of the first adsorption heat exchanger is heated by the refrigerant and is regenerated, whereas the adsorbent of the second adsorption heat exchanger is cooled by the refrigerant, and moisture in the air is adsorbed to this adsorbent.

On the other hand, when the four-way valve is in a second state, in which the first port and the fourth port are connected to each other and the second port and the third port are connected to each other, the high pressure side of the heat-source-side circuit and the second adsorption heat exchanger are connected to each other, and the low pressure side of the heat-source-side circuit and the first adsorption heat exchanger are connected to each other. In this state, the high-pressure refrigerant compressed by the compressor is separated into the humidity control circuits, and is condensed by the second adsorption heat exchanger. The condensed refrigerant is decompressed by the expansion valve, and thereafter evaporates in the first adsorption heat exchanger. The evaporated refrigerant is gathered in the heat-source-side circuit and is sucked again in the compressor. Thus, in the respective humidity control circuits, the adsorbent of the second adsorption heat exchanger is heated by the refrigerant and is regenerated, whereas the adsorbent of the first adsorption heat exchanger is cooled by the refrigerant, and moisture in the air is adsorbed to this adsorbent.

CITATION LIST

Patent Document

Patent Document 1:Japanese Unexamined Patent Publication No. 2005-315559

SUMMARY OF THE INVENTION

Technical Problem

The air conditioning system disclosed in Patent Document 1 has a problem, that is, when the four-way valve is switched, the switching sound generated due to pressure equalization between high pressure on the high pressure side and low pressure on the low pressure side of the humidity control circuit is transmitted to the connecting pipe and is enhanced.

Specifically, the first port and the third port are connected to each other when the four-way valve is in the first state, and therefore, high-pressure refrigerant flows in a refrigerant pipe connecting the third port of the four-way valve and the gas side end of the first adsorption heat exchanger. When the four-way valve is switched from the first state to the second state, the second port and the third port are connected to each other, and the gas side end of the first adsorption heat exchanger is connected to the suction-gas connecting pipe. Thus, the high-pressure refrigerant remaining in the refrigerant pipe before switching of the four-way valve abruptly flows into the suction-gas connecting pipe at the time of switching of the four-way valve, and the pressure equalization sound generated at this moment is transmitted to the connecting pipe and is enhanced.

The present invention is thus intended to reduce switching sound generated due to pressure equalization between high and low pressure in a humidity control circuit at the time of switching of a four-way valve.

Solution to the Problem

The present invention is directed to a humidity controller, including: a heat-source-side circuit (60) which has a compressor (33) that compresses a refrigerant; and a humidity control circuit (20) which has an adsorption heat exchanger (31, 32) carrying an adsorbent and a four-way valve (34) that switches a flow direction of the refrigerant, and which is connected to the heat-source-side circuit (60) by a connecting pipe (11, 12), and the humidity controller being configured to alternately perform, by switching the four-way valve (34), an adsorption operation in which the adsorption heat exchanger (31, 32) serves as an evaporator and moisture in air is adsorbed to the adsorbent, and a regeneration operation in which the adsorption heat exchanger (31, 32) serves as a condenser and the moisture is desorbed from the adsorbent, and the present invention provides the following solutions.

Specifically, the first aspect of the present invention includes a pressure difference reducing mechanism (40) which reduces a pressure difference between a high pressure side and a low pressure side in the humidity control circuit (20) before the four-way valve (34) is switched.

In the first aspect of the present invention, a pressure difference between the high pressure side and the low pressure side in the humidity control circuit (20) is reduced by the pressure difference reducing mechanism (40) before the four-way valve (34) is switched. With this configuration, it is possible to reduce transmission of switching sound, which is generated due to pressure equalization between the high pressure side and the low pressure side in the humidity control circuit (20), to the connecting pipe (11, 12) at the time of switching of the four-way valve (34).

Specifically, a high-pressure refrigerant flows in the refrigerant pipe (25) connecting the four-way valve (34) and the adsorption heat exchanger (31, 32) during a regeneration operation in which the adsorption heat exchanger (31, 32) serves as a condenser to desorb moisture from the adsorbent. Thus, when the four-way valve (34) is switched to perform an adsorption operation in which the adsorption heat exchanger (31, 32) serves as an evaporator to make the moisture in the air adsorbed to the adsorbent, the high-pressure refrigerant remaining in the refrigerant pipe (25) before switching of the four-way valve (34) abruptly flows to the low pressure side connecting pipe (12) at the switching of the four-way valve (34), and the pressure equalization sound generated at this moment is transmitted to the low pressure side connecting pipe (12) and is enhanced.

In contrast, in the present invention, since the pressure difference between the high and low pressure in the humidity control circuit (20) is reduced by the pressure difference reducing mechanism (40) before switching of the four-way valve (34), it is possible to make the refrigerant in the refrigerant pipe (25) an intermediate pressure, and possible to reduce an abrupt flow of the refrigerant to the low pressure side connecting pipe (12). As a result, the switching sound generated due to pressure equalization between high and low pressure in the humidity control circuit (20) can be reduced.

The second aspect of the present invention is that in the first aspect of the present invention, the humidity control circuit (20) includes an inlet pipe (23) and an outlet pipe (24), and the pressure difference reducing mechanism (40) includes a valve mechanism (45) connected to at least the outlet pipe (24) of the pipes (23, 24), and the valve mechanism (45) is comprised of an on-off valve (46) which, when closed, stops a flow of the refrigerant, or an electric-operated valve (47) with a variable degree of opening.

In the second aspect of the present invention, a valve mechanism (45) comprised of an on-off valve (46) or an electric-operated valve (47) is connected to at least the outlet pipe (24) of the pipes (23, 24) of the humidity control circuit (20). The flow of refrigerant in the inlet pipe (23) and the outlet pipe (24) is stopped by closing the on-off valve (46) or reducing the degree of opening of the electric-operated valve (47).

In this configuration, the flow of refrigerant in the humidity control circuit (20) is stopped before the four-way valve (34) is switched, by closing the on-off valve (46) or reducing the degree of opening of the electric-operated valve (47), thereby making it possible to make the pressure of the refrigerant in the refrigerant pipe (25) connecting the four-way valve (34) and the adsorption heat exchanger (31, 32) an intermediate pressure and reduce the pressure difference between high and low pressure.

The amount of refrigerant circulating in the humidity control circuit (20) is small during a low-load operation, and therefore, the amount of refrigerant remaining in the refrigerant pipe (25) is not very large even when the flow of the high-pressure refrigerant into the refrigerant pipe (25) is not stopped before switching of the four-way valve (34). Thus, in the humidity controller performing a low-load operation, it is possible to reduce the switching sound generated due to pressure equalization between high and low pressure in the humidity control circuit (20), by providing the pressure difference reducing mechanism (40) at only the outlet pipe (24) of the humidity control circuit (20).

The third aspect of the present invention is that in the second aspect of the present invention, a bypass pipe (41) for bypassing the valve mechanism (45) is connected to the pipe of the pipes (23, 24) of the humidity control circuit (20) to which the valve mechanism (45) is connected, the pressure difference reducing mechanism (40) includes a pressure-reducing valve (42) having a variable degree of opening and connected to the bypass pipe (41), and the pressure-reducing valve (42) is configured to reduce a pressure difference between preceding and succeeding portions with respect to the valve mechanism (45) before opening of the valve mechanism (45) by gradually increasing the degree of opening of the pressure-reducing valve (42) after switching of the four-way valve (34).

In the third aspect of the present invention, a bypass pipe (41) for bypassing the valve mechanism (45) is connected to the pipe of the inlet pipe (23) and the outlet pipe (24) of the humidity control circuit (20) to which the valve mechanism (45) is connected. A pressure-reducing valve (42) with a variable degree of opening is connected to the bypass pipe (41). The pressure difference between preceding and succeeding portions with respect to the valve mechanism (45) is reduced before opening of the valve mechanism (45) by gradually increasing the degree of opening of the pressure-reducing valve (42) after switching of the four-way valve (34).

With this configuration, it is possible to equalize pressure between preceding and succeeding portions with respect to the valve mechanism (45) by using the pressure-reducing valve (42) before opening of the valve mechanism (45). It is therefore possible to reduce abrupt changes in pressure at the time of opening of the valve mechanism (45) and reduce switching sound.

Advantages of the Invention

In the present invention, a pressure difference between high and low pressure in the humidity control circuit (20) is reduced by the pressure difference reducing mechanism (40) before the four-way valve (34) is switched. It is therefore possible to make the pressure of the refrigerant in the refrigerant pipe (25) an intermediate pressure, and reduce an abrupt flow of the refrigerant to the low pressure side connecting pipe (12). As a result, the switching sound generated due to pressure equalization between high and low pressure in the humidity control circuit (20) can be reduced.

DESCRIPTION OF EMBODIMENTS

Embodiments of the present invention will be described below based on the drawings. The following embodiments are merely preferred examples in nature, and are not intended to limit the scope, applications, and use of the invention.

<<First Embodiment>>

Figure 1:
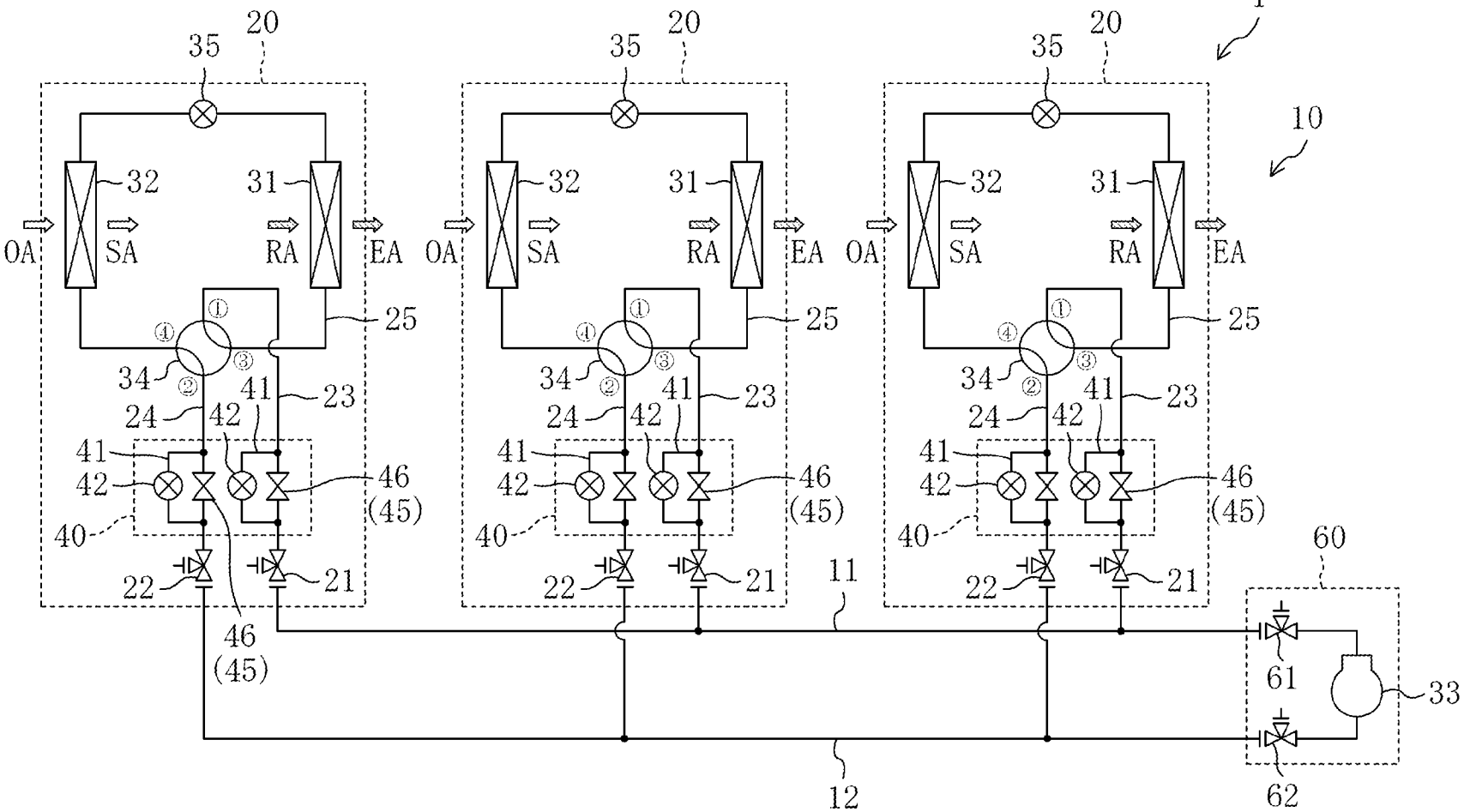
FIG. 1 is a piping diagram illustrating a configuration of a refrigerant circuit of a humidity controller according to the first embodiment of the present invention, and shows the first operation.

FIG. 1 is a piping diagram illustrating a configuration of a refrigerant circuit of a humidity controller according to the first embodiment of the present invention. As shown in FIG. 1, a humidity controller (1) includes a refrigerant circuit (10) which performs a vapor-compression refrigeration cycle by circulating a refrigerant. The refrigerant circuit (10) includes a heat-source-side circuit (60), and three humidity control circuits (20) which are connected in parallel to the heat-source-side circuit (60) by a high pressure side connecting pipe (11) and a low pressure side connecting pipe (12). The number of the humidity control circuits (20) is just an example.

A compressor (33), a high pressure side shut-off valve (61), and a low pressure side shut-off valve (62) are connected to the heat-source-side circuit (60). The compressor (33) is comprised of a so-called inverter compressor of which the number of rotation of a motor (i.e., a capacity of the compressor) is variable. Further, the compressor (33) is comprised of a scroll type compressor, for example.

The humidity control circuits (20) control humidity of the outdoor air (OA) taken therein and supply the outdoor air into a room. The humidity control circuits (20) are placed above the ceiling, for example. A first adsorption heat exchanger (31), an electric-operated expansion valve (35), and a second adsorption heat exchanger (32) are sequentially connected to each of the humidity control circuits (20).

The first adsorption heat exchanger (31) and the second adsorption heat exchanger (32) carry an adsorbent on their surfaces to adsorb and desorb moisture in the air. The electric-operated expansion valve (35) is comprised of an electronic expansion valve with a variable degree of opening. Further, a four-way valve (34) for switching a flow direction of the refrigerant is connected to each of the humidity control circuits (20).

The four-way valve (34) includes first to fourth ports. The first port of the four-way valve (34) is connected to an inlet pipe (23) of each humidity control circuit (20). A valve mechanism (45) which comprises a pressure difference reducing mechanism (40), and a high pressure side shut-off valve (21) are connected to the inlet pipe (23). The high pressure side shut-off valve (61) of the heat-source-side circuit (60) and the high pressure side shut-off valve (21) of the humidity control circuit (20) are connected to each other by the high pressure side connecting pipe (11). Thus, each of the humidity control circuits (20) is connected to the high pressure side of the heat-source-side circuit (60) by the high pressure side connecting pipe (11).

Further, the second port of the four-way valve (34) is connected to an outlet pipe (24) of the second port of each humidity control circuit (20). A valve mechanism (45) and a low pressure side shut-off valve (22) are connected to the outlet pipe (24). The low pressure side shut-off valve (62) of the heat-source-side circuit (60) and the low pressure side shut-off valve (22) of the humidity control circuit (20) are connected to each other by the low pressure side connecting pipe (12). Thus, each of the humidity control circuits (20) is connected to the low pressure side of the heat-source-side circuit (60) by the low pressure side connecting pipe (12).

Further, the third port of the four-way valve (34) is connected to one end of the first adsorption heat exchanger (31), and the fourth port of the four-way valve (34) is connected to one end of the second adsorption heat exchanger (32).

Figure 2:
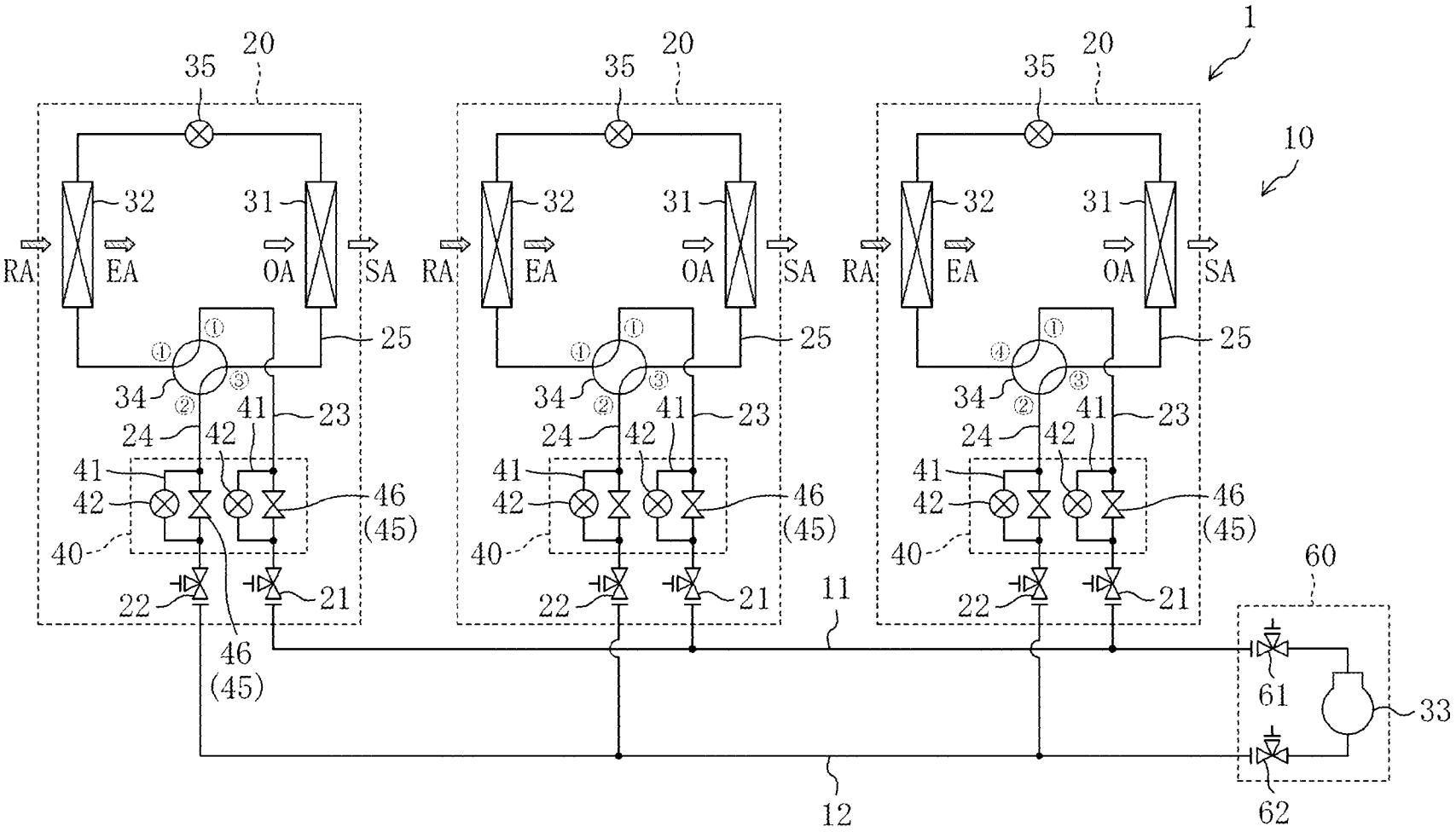
FIG. 2 is a piping diagram illustrating the configuration of the refrigerant circuit of the humidity controller, and shows the second operation.

The four-way valve (34) is switchable between a first state in which the first port and the third port communicate with each other and the second port and the fourth port communicate with each other, and a second state (see FIG. 2) in which the first port and the fourth port communicate with each other and the second port and the third port communicate with each other.

That is, the four-way valve (34) in the first state shown in FIG. 1 connects the high pressure side of the heat-source-side circuit (60) and one end of the first adsorption heat exchanger (31), and connects the low pressure side of the heat-source-side circuit (60) and one end of the second adsorption heat exchanger (32). The four-way valve (34) in the second state shown in FIG. 2 connects the high pressure side of the heat-source-side circuit (60) and the second adsorption heat exchanger (32), and connects the low pressure side of the heat-source-side circuit (60) and the first adsorption heat exchanger (31).

The valve mechanism (45) is comprised of an on-off valve (46) which, in its closed state, shuts off the flow of refrigerant. A bypass pipe (41) which bypasses the on-off valve (46) is connected to each of the inlet pipe (23) and the outlet pipe (24) of the humidity control circuits (20). A pressure-reducing valve (42) with a variable degree of opening is connected to the bypass pipe (41). The pressure-reducing valve (42) is comprised of a small-diameter valve with a small nominal diameter. The pressure difference reducing mechanism (40) is comprised of the valve mechanism (45) and the pressure-reducing valve (42).

—Operation—

The humidity controller (1) of the present embodiment selectively performs a dehumidification ventilation operation and a humidification ventilation operation. In the dehumidification ventilation operation and the humidification ventilation operation, the humidity control circuits (20) perform a humidity control operation, in which the outdoor air (OA) taken therein is humidity controlled and is then supplied into a room as supply air (SA), and the room air (RA) simultaneously taken therein is exhausted outside as exhaust air (EA). The respective operations of the humidity control circuits (20) will be described in detail below.

<Dehumidification Ventilation Operation>

In each of the humidity control circuits in the dehumidification ventilation operation, a first operation and a second operation are alternately repeated at a predetermined time interval (e.g., three minutes). In the humidity control circuit (20) in the dehumidification ventilation operation, outdoor air (OA) is taken from an outdoor air inlet port as first air, and room air (RA) is taken from an indoor air inlet port as second air.

First, the first operation of the dehumidification ventilation operation will be described. In the refrigerant circuit (10) in the first operation, the four-way valve (34) is set to the first state (the state shown in FIG. 1); the first adsorption heat exchanger (31) serves as a condenser; and the second adsorption heat exchanger (32) serves as an evaporator.

The first air taken from the outdoor air inlet port passes through the second adsorption heat exchanger (32). The second adsorption heat exchanger (32) performs an adsorption operation, in which moisture in the first air is adsorbed to the adsorbent, and adsorption heat generated during the adsorption operation is absorbed by the refrigerant. The supply air (SA) dehumidified in the second adsorption heat exchanger (32) is supplied into a room through an air supply port.

On the other hand, the room air (RA), i.e., the second air, taken from the indoor air inlet port passes through the first adsorption heat exchanger (31). The first adsorption heat exchanger (31) performs a regeneration operation, in which moisture is desorbed from the adsorbent heated by the refrigerant, and the moisture desorbed is given to the second air. The exhaust air (EA) to which the moisture has been given in the first adsorption heat exchanger (31) is exhausted outside through an exhaust port.

Next, the second operation of the dehumidification ventilation operation will be described. The four-way valve (34) needs to be switched from the first state to the second state (the state shown in FIG. 2) so that the refrigerant circuit (10) can perform the second operation. In the present embodiment, the on-off valve (46) is closed to stop the flow of refrigerant in the respective humidity control circuits (20) before switching of the four-way valve (34).

Figure 3:
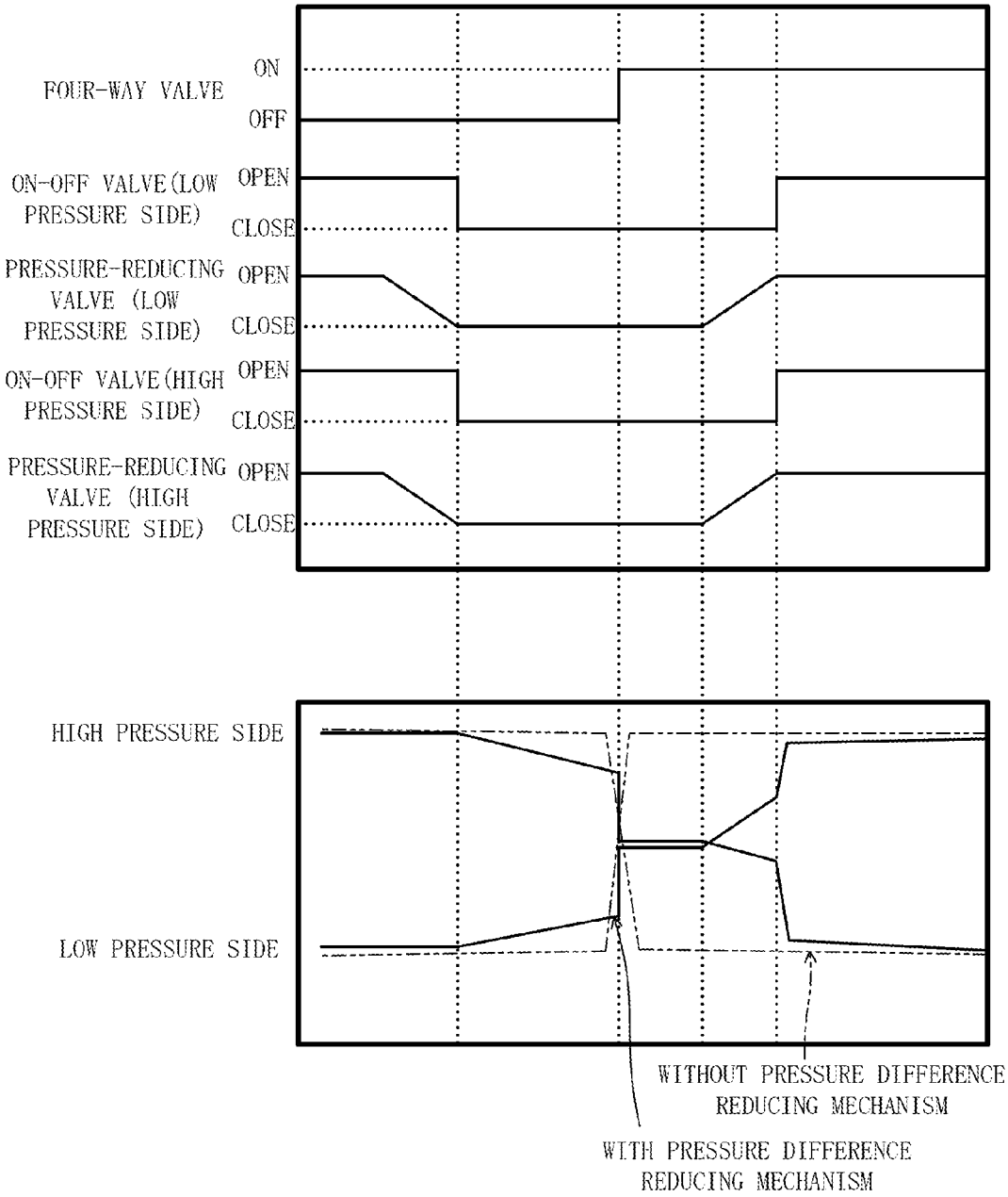
FIG. 3 is a timing chart showing switching timings of a four-way valve, an on-off valve, and a pressure-reducing valve, and changes in pressure difference between high and low pressure in a humidity control circuit at the switching timings.

Specifically, first, the pressure-reducing valve (42) and the on-off valve (46) are closed as shown in FIG. 3. After the on-off valve (46) is closed, the four-way valve (34) is switched from the first state to the second state to make the pressure in the respective humidity control circuits (20) an intermediate pressure. That is, in the refrigerant circuit (10) during the second operation, the four-way valve (34) is set to the second state (the state shown in FIG. 2); the first adsorption heat exchanger (31) serves as an evaporator; and the second adsorption heat exchanger (32) serves as a condenser.

After the four-way valve (34) is switched to the second state, the degree of opening of the pressure-reducing valve (42) is gradually increased as shown in FIG. 3 before opening of the on-off valve (46), thereby reducing a pressure difference between preceding and succeeding portions with respect to the on-off valve (46). After that, the on-off valve (46) is opened. As a result, it is possible to reduce abrupt changes in pressure at the time of opening of the on-off valve (46).

By reducing a pressure difference between the high pressure side and the low pressure side in the humidity control circuit (20) before switching of the four-way valve (34), using the pressure-reducing valve (42) and the on-off valve (46) as described above, it is possible to reduce transmission of switching sound, which is generated due to pressure equalization between high and low pressure in the humidity control circuit (20), to the low pressure side connecting pipe (12) at the time of switching of the four-way valve (34).

Specifically, when the four-way valve (34) is in the first state, a high-pressure refrigerant flows in a refrigerant pipe (25) which connects the four-way valve (34) and the first adsorption heat exchanger (31). Thus, if the adsorption operation is conducted by switching the four-way valve (34) to allow the first adsorption heat exchanger (31) to serve as an evaporator and make the moisture in the air adsorbed to the adsorbent, the high-pressure refrigerant remaining in the refrigerant pipe (25) before switching of the four-way valve (34) abruptly flows to the low pressure side connecting pipe (12) at the time of switching of the four-way valve (34), and the pressure equalization sound generated at this moment is transmitted to the low pressure side connecting pipe (12) and is enhanced.

In contrast, according to the present embodiment, the pressure difference between high and low pressure in the humidity control circuit (20) is reduced by the pressure-reducing valve (42) and the on-off valve (46) before switching of the four-way valve (34). Thus, the refrigerant in the refrigerant pipe (25) is made an intermediate pressure, thereby making it possible to reduce an abrupt flow of the refrigerant to the low pressure side connecting pipe (12). As a result, the switching sound generated due to pressure equalization between high and low pressure in the humidity control circuit (20) can be reduced.

The first air taken from the outdoor air inlet port passes through the first adsorption heat exchanger (31). The first adsorption heat exchanger (31) performs an adsorption operation, in which moisture in the first air is adsorbed to the adsorbent, and the adsorption heat generated during the adsorption operation is absorbed by the refrigerant. The first air dehumidified in the first adsorption heat exchanger (31) is supplied into a room through the air supply port.

On the other hand, the second air taken from the indoor air inlet port passes through the second adsorption heat exchanger (32). The second adsorption heat exchanger (32) performs a regeneration operation, in which moisture is desorbed from the adsorbent heated by the refrigerant, and the moisture desorbed is given to the second air. The second air to which the moisture has been given in the second adsorption heat exchanger (32) is exhausted outside through the exhaust port.

<Humidification Ventilation Operation>

In each of the humidity control circuits (20) in the humidification ventilation operation, a first operation and a second operation are alternately repeated at a predetermined time interval (e.g., four minutes). In the humidity control circuit (20) in the humidification ventilation operation, outdoor air (OA) is taken from the outdoor air inlet port as second air, and room air (RA) is taken from the indoor air inlet port as first air.

First, the first operation of the humidification ventilation operation will be described. In the refrigerant circuit (10) in the first operation, the four-way valve (34) is set to the first state (i.e., the state shown in FIG. 1); the first adsorption heat exchanger (31) serves as a condenser; and the second adsorption heat exchanger (32) serves as an evaporator.

The first air taken from the indoor air inlet port passes through the second adsorption heat exchanger (32). The second adsorption heat exchanger (32) performs an adsorption operation, in which moisture in the first air is adsorbed to the adsorbent, and adsorption heat generated during the adsorption operation is absorbed by the refrigerant. The first air from which the moisture has been taken in the second adsorption heat exchanger (32) is exhausted outside through the exhaust port.

On the other hand, the second air taken from the outdoor air inlet port passes through the first adsorption heat exchanger (31). The first adsorption heat exchanger (31) performs a regeneration operation, in which moisture is desorbed from the adsorbent heated by the refrigerant, and the moisture desorbed is given to the second air. The second air humidified in the first adsorption heat exchanger (31) is supplied into a room through the air supply port.

Next, the second operation of the humidification ventilation operation will be described. In the refrigerant circuit (10) during the second operation, the four-way valve (34) is set to the second state (the state shown in FIG. 2); the first adsorption heat exchanger (31) serves as an evaporator; and the second adsorption heat exchanger (32) serves as a condenser. Similar to the dehumidification ventilation operation described above, a pressure difference between high and low pressure in the humidity control circuit (20) is reduced by the pressure-reducing valve (42) and the on-off valve (46) before the four-way valve (34) is switched.

The first air taken from the indoor air inlet port passes through the first adsorption heat exchanger (31). The first adsorption heat exchanger (31) performs an adsorption operation, in which moisture in the first air is adsorbed to the adsorbent, and the adsorption heat generated during the adsorption operation is absorbed by the refrigerant. The first air from which the moisture has been taken in the first adsorption heat exchanger (31) is exhausted outside through the exhaust port.

On the other hand, the second air taken from the outdoor air inlet port passes through the second adsorption heat exchanger (32). The second adsorption heat exchanger (32) performs a regeneration operation, in which moisture is desorbed from the adsorbent heated by the refrigerant, and the moisture desorbed is given to the second air. The second air humidified in the second adsorption heat exchanger (32) is supplied into a room through the air supply port.

—Advantages of the First Embodiment—

As described above, in the humidity controller (1) of the first embodiment, the on-off valve (46) is closed to stop the flow of refrigerant in the respective humidity control circuits (20) before the four-way valve (34) is switched. Thus, the refrigerant in the refrigerant pipe (25) connecting the four-way valve (34) and the first and second adsorption heat exchangers (31, 32) is made an intermediate pressure, thereby making it possible to reduce a pressure difference between high and low pressure in the humidity control circuit (20). As a result, it is possible to reduce an abrupt flow of the refrigerant in the refrigerant pipe (25) to the low pressure side connecting pipe (12) at the time of switching the four-way valve (34), and therefore possible to reduce switching sound generated due to pressure equalization between the high and low pressure in the humidity control circuit (20).

Further, in the first embodiment, the degree of opening of the pressure-reducing valve (42) is gradually increased to reduce a pressure difference between preceding and succeeding portions with respect to the on-off valve (46) before the on-off valve (46) is opened. As a result, it is possible to reduce abrupt changes in pressure at the time of opening of the on-off valve (46), and possible to reduce the switching sound.

<<Second Embodiment>>

Figure 4:
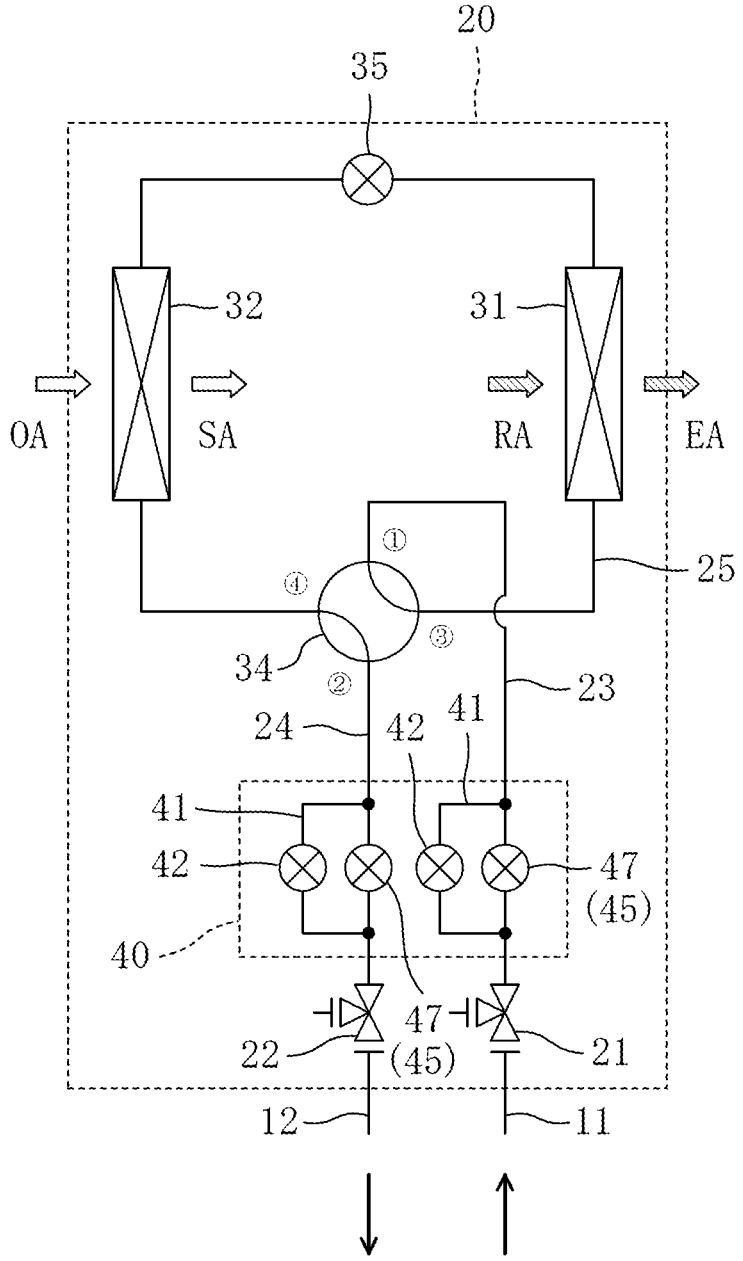
FIG. 4 is a piping diagram illustrating a humidity control circuit of a humidity controller according to the second embodiment.

FIG. 4 is a piping diagram illustrating a humidity control circuit of a humidity controller according to the second embodiment. The second embodiment is different from the first embodiment in that an electric-operated valve (47) is used in place of the on-off valve (46). Thus, in the following description, like reference characters have been used to designate the same elements as those in the first embodiment, and only the differences will be explained.

As shown in FIG. 4, a valve mechanism (45) is connected to each of an inlet pipe (23) and outlet pipe (24) of the humidity control circuit (20). The valve mechanism (45) is comprised of an electric-operated valve (47) with a variable degree of opening. The electric-operated valve (47) is comprised of a large-diameter valve with a large nominal diameter.

A bypass pipe (41) which bypasses the electric-operated valve (47) is connected to each of the inlet pipe (23) and the outlet pipe (24) of the humidity control circuit (20). A pressure-reducing valve (42) with a variable degree of opening is connected to the bypass pipe (41). The pressure-reducing valve (42) is comprised of a small-diameter valve with a nominal diameter smaller than the nominal diameter of the electric-operated valve (47).

Figure 5:
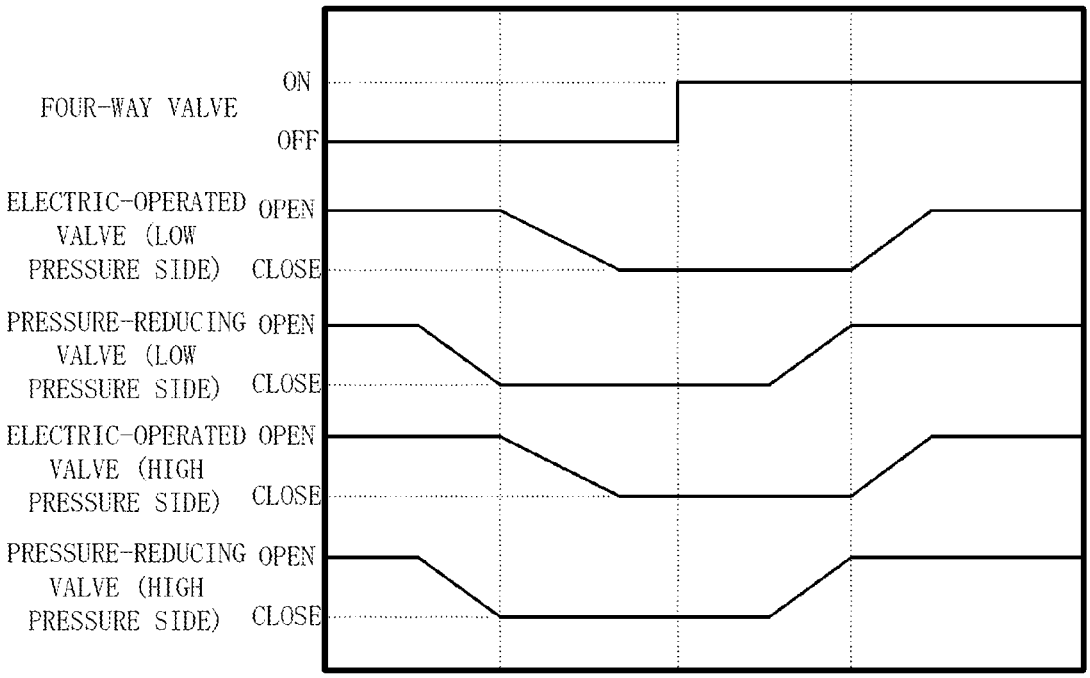
FIG. 5 is a timing chart showing switching timings of a four-way valve, an electric-operated valve, and a pressure-reducing valve.

FIG. 5 is a timing chart showing switching timings of the four-way valve, the electric-operated valve, and the pressure-reducing valve. As shown in FIG. 5, the electric-operated valve (47) is closed to stop the flow of refrigerant in the humidity control circuit (20) before the four-way valve (34) is switched.

Specifically, first, the degree of opening of the pressure-reducing valve (42) and the degree of opening of the electric-operated valve (47) are gradually reduced. After the electric-operated valve (47) is closed, the four-way valve (34) is switched from the first state to the second state to make the pressure in the humidity control circuit (20) an intermediate pressure. That is, in the refrigerant circuit (10) during the second operation, the four-way valve (34) is set to the second state; the first adsorption heat exchanger (31) serves as an evaporator; and the second adsorption heat exchanger (32) serves as a condenser.

After the four-way valve (34) is switched to the second state, the degree of opening of the pressure-reducing valve (42) is gradually increased before opening of the electric-operated valve (47), thereby reducing a pressure difference between preceding and succeeding portions with respect to the electric-operated valve (47). After that, the degree of opening of the electric-operated valve (47) is gradually increased to an open state. As a result, it is possible to reduce abrupt changes in pressure at the time of opening of the electric-operated valve (47).

According to the second embodiment, by reducing a pressure difference between the high pressure side and the low pressure side in the humidity control circuit (20) before switching of the four-way valve (34), using the pressure-reducing valve (42) and the electric-operated valve (47) as described above, it is possible to reduce transmission of switching sound, which is generated due to pressure equalization between high and low pressure in the humidity control circuit (20), to the low pressure side connecting pipe (12) at the time of switching of the four-way valve (34).

<<Third Embodiment>>

Figure 6:
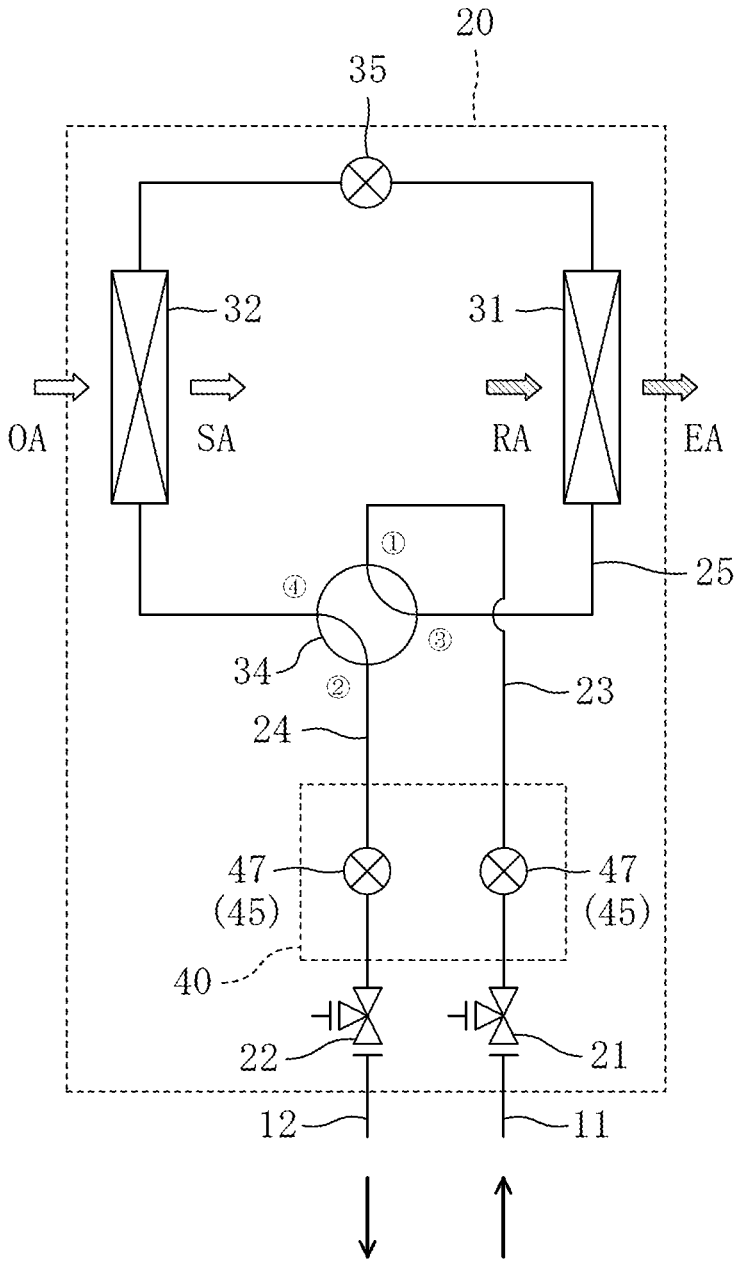
FIG. 6 is a piping diagram illustrating a humidity control circuit of a humidity controller according to the third embodiment.

FIG. 6 is a piping diagram illustrating a humidity control circuit of a humidity controller according to the third embodiment. As shown in FIG. 6, a valve mechanism (45) is connected to each of the inlet pipe (23) and the outlet pipe (24) of the humidity control circuit (20). The valve mechanism (45) is comprised of an electric-operated valve (47) with a variable degree of opening. The electric-operated valve (47) is comprised of a large-diameter valve with a large nominal diameter.

The degree of opening of the electric-operated valve (47) is gradually reduced to a closed state to stop the flow of refrigerant in the humidity control circuit (20) before the four-way valve (34) is switched. Thus, a pressure difference between the high pressure side and the low pressure side in the humidity control circuit (20) is reduced, thereby making it possible to reduce transmission of switching sound, which is generated due to pressure equalization between high and low pressure in the humidity control circuit (20), to the low pressure side connecting pipe (12) at the time of switching of the four-way valve (34).

In the third embodiment, the pressure difference reducing mechanism (40) is comprised of only the electric-operated valve (47) with a large diameter as described above. It is therefore not necessary to provide the bypass pipe (41) and the pressure-reducing valve (42), and possible to reduce costs.

<<Fourth Embodiment>>

Figure 7:
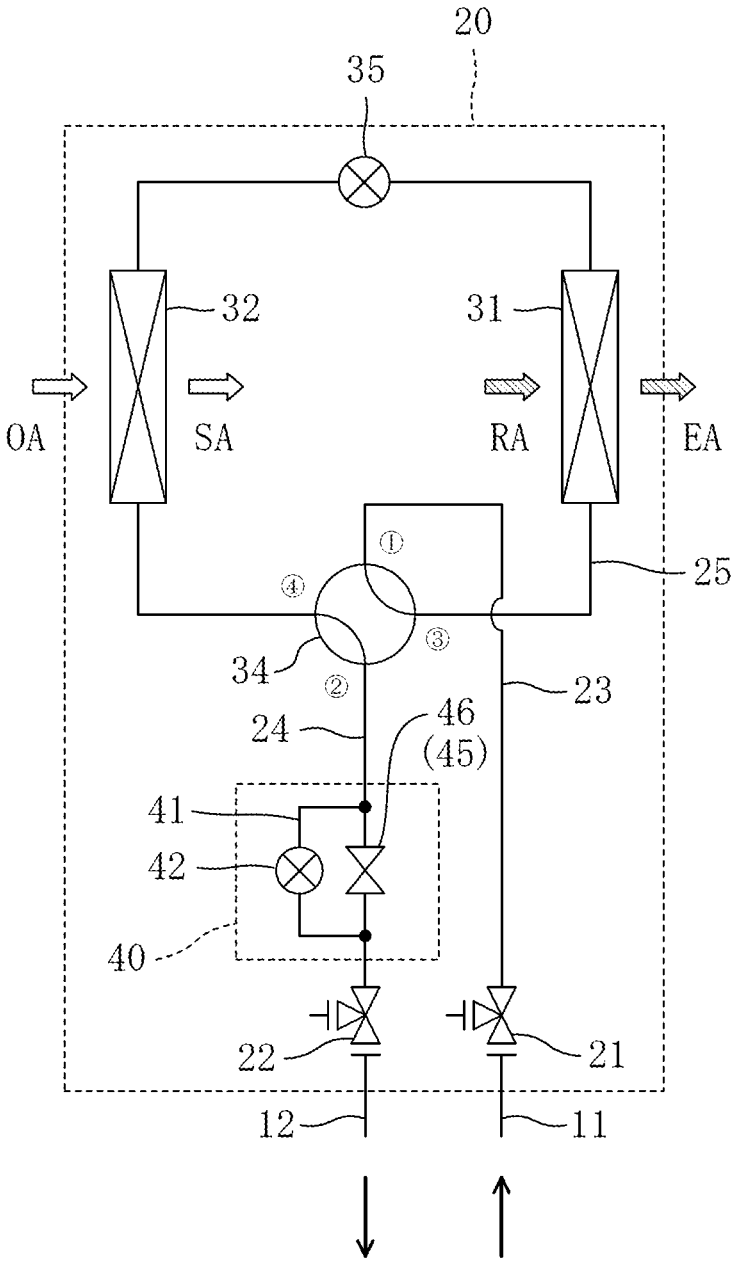
FIG. 7 is a piping diagram illustrating a humidity control circuit of a humidity controller according to the fourth embodiment.

FIG. 7 is a piping diagram illustrating a humidity control circuit of a humidity controller according to the fourth embodiment. The fourth embodiment is different from the first embodiment in that a valve mechanism (45) is provided at only an outlet pipe (24). Thus, in the following description, like reference characters have been used to designate the same elements as those in the first embodiment, and only the differences will be explained.

As shown in FIG. 7, a valve mechanism (45) is connected to an outlet pipe (24) of the humidity control circuit (20). The valve mechanism (45) is comprised of an on-off valve (46) which, when closed, stops the flow of refrigerant. A bypass pipe (41) which bypasses the on-off valve (46) is connected to the outlet pipe (24). A pressure-reducing valve (42) with a variable degree of opening is connected to the bypass pipe (41). The pressure-reducing valve (42) is comprised of a small-diameter valve with a small nominal diameter. A pressure difference reducing mechanism (40) is comprised of the valve mechanism (45) and the pressure-reducing valve (42).

In the humidity controller (1) performing a low-load operation, it is possible to reduce the switching sound generated due to pressure equalization between high and low pressure in the humidity control circuit (20), by providing the pressure difference reducing mechanism (40) at only the outlet pipe (24) of the humidity control circuit (20).

Specifically, as described in the first embodiment, the amount of refrigerant circulating in the humidity control circuit (20) is large during a high-load operation, and therefore, the amount of refrigerant remaining in the refrigerant pipe (25) connecting the four-way valve (34) and the first and second adsorption heat exchangers (31, 32) is also large. Thus, the refrigerant in the refrigerant pipe (25) needs to be in an intermediate pressure before switching of the four-way valve (34) by closing the on-off valve (46) and stopping the flow of the refrigerant in the humidity control circuit (20).

In contrast, the amount of refrigerant circulating in the humidity control circuit (20) is small during a low-load operation, and therefore, the amount of refrigerant remaining in the refrigerant pipe (25) is not very large even when the flow of the high-pressure refrigerant into the refrigerant pipe (25) is not stopped before switching of the four-way valve (34).

Thus, in the humidity controller (1) of the fourth embodiment, the pressure difference reducing mechanism (40) is provided at only the outlet pipe (24), and the on-off valve (46) connected to the outlet pipe (24) is closed before the four-way valve (34) is switched. That is, in switching the four-way valve (34), the refrigerant in the refrigerant pipe (25) is prevented from abruptly flowing to the low pressure side connecting pipe (12), and before opening of the on-off valve (46), the degree of opening of the pressure-reducing valve (42) is gradually increased to reduce a pressure difference between preceding and succeeding portions with respect to the on-off valve (46). As a result, it is possible to reduce abrupt changes in pressure at the time of opening of the on-off valve (46), and possible to reduce the switching sound.

In the fourth embodiment, an example in which the pressure difference reducing mechanism (40) is comprised of the on-off valve (46) and the pressure-reducing valve (42) has been described, but the configuration is not limited to this example. For example, the pressure difference reducing mechanism (40) may be comprised of the electric-operated valve (47) and the pressure-reducing valve (42) as shown in FIG. 4. Further, the pressure difference reducing mechanism (40) may be comprised of only the electric-operated valve (47) with a large diameter as shown in FIG. 6.

Industrial Applicability

As described above, the present invention has considerable advantages in practical use, that is, being capable of reducing switching sound generated due to pressure equalization between high and low pressure in a humidity control circuit at the time of switching a four-way valve. Thus, the present invention is very useful and highly applicable in the industry.

DESCRIPTION OF REFERENCE CHARACTERS

1 humidity controller
11 high pressure side connecting pipe
12 low pressure side connecting pipe
20 humidity control circuit
23 inlet pipe
24 outlet pipe
31 first adsorption heat exchanger
32 second adsorption heat exchanger
33 compressor
34 four-way valve
40 pressure difference reducing mechanism
41 bypass pipe
42 pressure-reducing valve
45 valve mechanism
46 on-off valve
47 electric-operated valve
60 heat-source-side circuit

The invention claimed is:

1. A humidity controller, including:

a heat-source-side circuit which has a compressor that compresses a refrigerant; and a humidity control circuit which has an adsorption heat exchanger carrying an adsorbent and a four-way valve that switches a flow direction of the refrigerant, and which is connected to the heat-source-side circuit by a connecting pipe, and the humidity controller being configured to alternately perform, by switching the four-way valve, an adsorption operation in which the adsorption heat exchanger serves as an evaporator and moisture in air is adsorbed to the adsorbent, and a regeneration operation in which the adsorption heat exchanger serves as a condenser and the moisture is desorbed from the adsorbent, the humidity controller comprising:

a pressure difference reducing mechanism which reduces a pressure difference between a high pressure side and a low pressure side in the humidity control circuit before the four-way valve is switched, wherein the humidity control circuit includes an inlet pipe and an outlet pipe, and the pressure difference reducing mechanism includes a valve mechanism connected to at least the outlet pipe of the pipes, the valve mechanism is comprised of an on-off valve which, when closed, stops a flow of the refrigerant, or an electric-operated valve with a variable degree of opening, a bypass pipe for bypassing the valve mechanism is connected to the pipe of the pipes of the humidity control circuit to which the valve mechanism is connected, the pressure difference reducing mechanism includes a pressure-reducing valve having a variable degree of opening and connected to the bypass pipe, and the pressure-reducing valve is configured to reduce a pressure difference between preceding and succeeding portions with respect to the valve mechanism before opening of the valve mechanism by gradually increasing the degree of opening of the pressure-reducing valve after switching of the four-way valve.

* * * * *